US010564581B1

(12) United States Patent
Kuramoto et al.

(10) Patent No.: US 10,564,581 B1
(45) Date of Patent: Feb. 18, 2020

(54) IMAGE FORMING APPARATUS

(71) Applicant: FUJI XEROX CO., LTD., Tokyo (JP)

(72) Inventors: Kazuki Kuramoto, Kanagawa (JP); Yasuhiro Funayama, Kanagawa (JP); Hirofumi Hamada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/286,623

(22) Filed: Feb. 27, 2019

(30) Foreign Application Priority Data

Sep. 25, 2018 (JP) ..... 2018-178347

(51) Int. Cl.
*G03G 15/00* (2006.01)
*G03G 15/08* (2006.01)

(52) U.S. Cl.
CPC ..... *G03G 15/50* (2013.01); *G03G 15/0877* (2013.01)

(58) Field of Classification Search
CPC .. G03G 15/50; G03G 15/065; G03G 15/1675; G03G 15/5037; G03G 15/043; G03G 15/0283; G03G 15/0266; G03G 15/0877
See application file for complete search history.

(56) References Cited

U.S. PATENT DOCUMENTS 5,652,953 A * 7/1997 Imai ..... G03G 15/065 347/129
6,463,240 B2 * 10/2002 Onuki ..... G03G 15/0266 399/128

FOREIGN PATENT DOCUMENTS

JP 2001209292 8/2001

* cited by examiner

*Primary Examiner* — Sandra Brase
(74) *Attorney, Agent, or Firm* — JCIPRNET

(57) ABSTRACT

An image forming apparatus includes a photoreceptor, a charging unit, an exposure unit, a developing unit, a transfer unit, a detector, and a controller. The charging unit charges the photoreceptor. The exposure unit exposes the photoreceptor charged by the charging unit to light and forms an electrostatic latent image on the photoreceptor. The developing unit develops the electrostatic latent image that has been exposed by the exposure unit and formed on the photoreceptor. The transfer unit transfers an image obtained by development by the developing unit to a transfer object. The detector detects strip developer, which is a strip-shaped developer image formed on the transfer object. The controller controls at least one of the charging unit, the exposure unit, the developing unit, and the transfer unit, based on a length of the strip developer in a conveying direction detected by the detector, such that timings for varying potentials of the photoreceptor and the developing unit in a same direction are equal to each other.

19 Claims, 6 Drawing Sheets

IMAGE FORMING APPARATUS

CROSS-REFERENCE TO RELATED APPLICATIONS

This application is based on and claims priority under 35 USC 119 from Japanese Patent Application No. 2018-178347 filed Sep. 25, 2018.

BACKGROUND

(i) Technical Field

The present disclosure relates to an image forming apparatus.

(ii) Related Art

An image forming apparatus with a reduced consumption of toner by density control and an improved accuracy in detection of density is disclosed in Japanese Unexamined Patent Application Publication No. 2001-209292.

SUMMARY

Aspects of non-limiting embodiments of the present disclosure relate to easily suppressing image defects caused by strip developer, which is a strip-shaped developer image formed on a transfer object, compared to a configuration that requires adjustment by an operator every time that an image defect caused by the strip developer is corrected.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including a photoreceptor, a charging unit, an exposure unit, a developing unit, a transfer unit, a detector, and a controller. The charging unit charges the photoreceptor. The exposure unit exposes the photoreceptor charged by the charging unit to light and forms an electrostatic latent image on the photoreceptor. The developing unit develops the electrostatic latent image that has been formed on the photoreceptor by exposing the photoreceptor by the exposing unit. The transfer unit transfers an image obtained by development by the developing unit to a transfer object. The detector detects strip developer, which is a strip-shaped developer image formed on the transfer object. The controller controls at least one of the charging unit, the exposure unit, the developing unit, and the transfer unit, based on a length of the strip developer in a conveying direction detected by the detector, such that timings for varying potentials of the photoreceptor and the developing unit in a same direction are equal to each other.

BRIEF DESCRIPTION OF THE DRAWINGS

Exemplary embodiments of the present disclosure will be described in detail based on the following figures, wherein.

DETAILED DESCRIPTION

Hereinafter, for explanation of an image forming apparatus 10 according to an exemplary embodiment, directions based on the image forming apparatus 10 are used. That is, regarding the image forming apparatus 10 illustrated in FIG. 1, a width direction is referred to as a W direction, a height direction is referred to as an H direction, and a depth direction is referred to as a D direction. Furthermore, in this exemplary embodiment, recording paper P is adopted as a recording medium. An upstream side in a conveying direction in which the recording paper P is conveyed is referred to as a "conveying direction upstream side", and a downstream side in the conveying direction is referred to as a "conveying direction downstream side".

First Exemplary Embodiment

First, a first exemplary embodiment will be explained.

(Configuration of Image Forming Apparatus)

Figure 1:
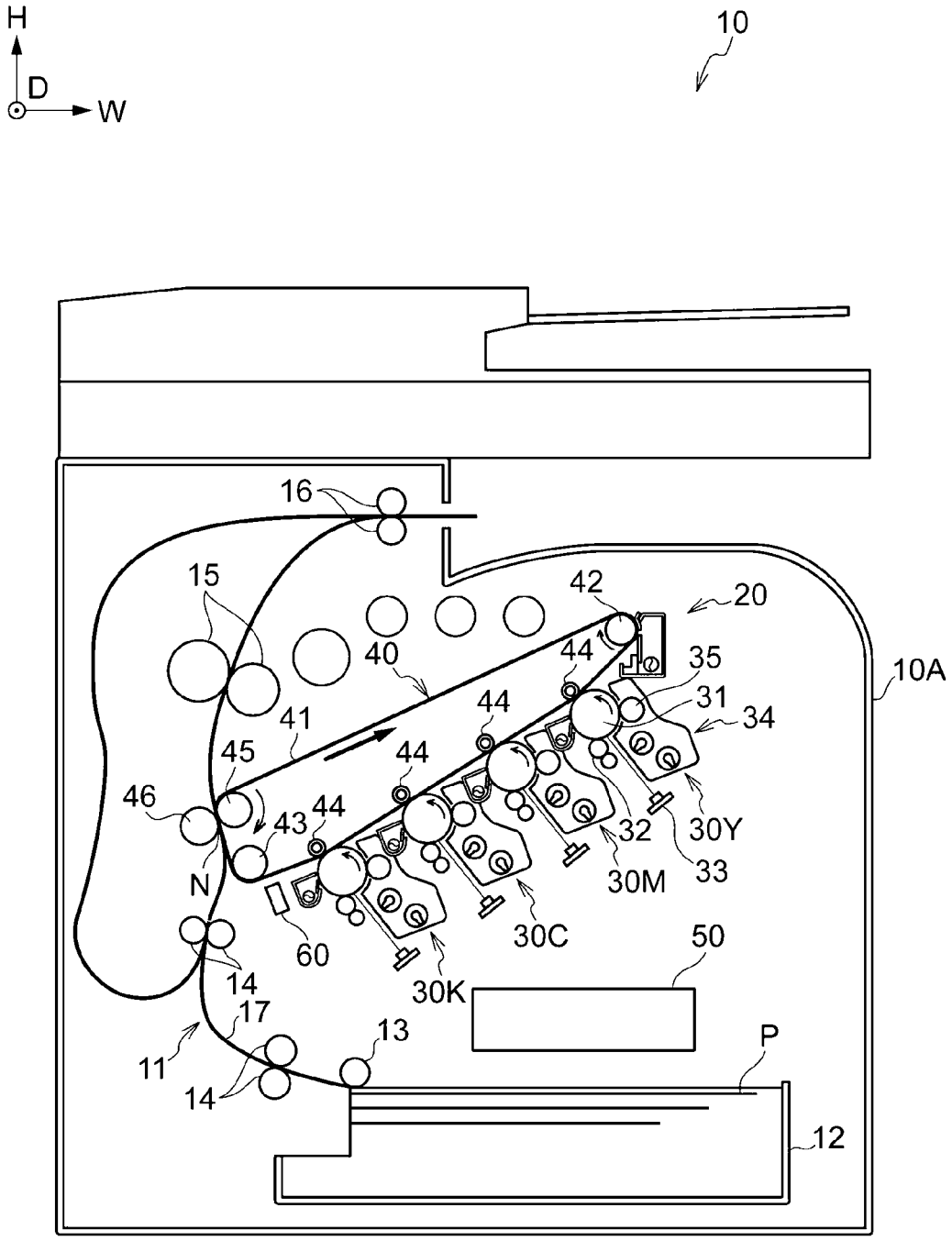
FIG. 1 is a front view of an image forming apparatus according to an exemplary embodiment.

As illustrated in FIG. 1, the image forming apparatus 10 includes an accommodation unit 12 that accommodates the recording paper P, a conveyance unit 11 that conveys the recording paper P, an image forming section 20 that forms a toner image to be transferred to the recording paper P, and a controller 50 that controls an operation of the image forming apparatus 10. The details of the controller 50 will be described later.

The accommodation unit 12 may be drawn out from an image forming apparatus body 10A, which is an apparatus body of the image forming apparatus 10, and the recording paper P is accommodated in the accommodation unit 12.

The conveyance unit 11 includes a feed roller 13, a plurality of conveyance rollers 14, fixation rollers 15, and discharge rollers 16 in that order from the conveying direction upstream side.

The feed roller 13 feeds the recording paper P accommodated in the accommodation unit 12 to a conveyance path 17 that forms the conveyance unit 11.

The conveyance rollers 14 convey the recording paper P to the conveying direction downstream side along the conveyance path 17.

The fixation rollers 15 heat and pressurize the recording paper P to which a toner image has been transferred while fixing the toner image onto the recording paper P, and convey the recording paper P to the conveying direction downstream side along the conveyance path 17.

The discharge rollers 16 discharge the recording paper P onto which the toner image has been fixed to the outside of the image forming apparatus body 10A.

The image forming section 20 includes image forming units 30Y, 30M, 30C, and 30K as image forming units 30 that form toner images of individual colors. In the case where there is no need to distinguish among Y, M, C, and K in the image forming units 30, distinction among Y, M, C, and K is omitted.

Each of the image forming units 30 is detachable from the image forming apparatus body 10A. The image forming units 30 each include a photoreceptor 31, a charging member 32 that negatively charges the surface of the photoreceptor 31 in a uniform manner at a predetermined potential, an exposure device 33 that irradiates the charged photoreceptor 31 with exposure light, and a developing device 34 that develops an electrostatic latent image formed by irradiation with exposure light and visualizes the developed image as a toner image. The charging member 32 is an example of a charging unit, the exposure device 33 is an example of an exposure unit, and the developing device 34 is an example of a developing unit.

The charging member 32 in the first exemplary embodiment is configured to perform charging by being in contact with the photoreceptor 31. For example, a bias charge roller (BCR) including a metal shaft that is covered with a semiconductor elastic material in a layered manner is used as the charging member 32. When voltage is applied from a power source (not illustrated) to the charging member 32, the charging member 32 charges the photoreceptor 31. Furthermore, a light-emitting diode (LED) printer head (LPH) is used as the exposure device 33 in the first exemplary embodiment. The exposure device 33 reduces the surface potential of a part of the photoreceptor 31 that is irradiated with exposure light (hereinafter, referred to as a "photoreceptor potential"). When electric power is supplied from the power source (not illustrated) to the exposure device 33, the exposure device 33 irradiates the photoreceptor 31 with exposure light. Furthermore, the developing device 34 in the first exemplary embodiment includes a developing roller 35 that holds developer of a corresponding color including toner and carrier. When a developing bias is applied from the power source (not illustrated) to the developing roller 35, the developing device 34 develops an electrostatic latent image on the photoreceptor 31 in a corresponding color and visualizes the developed image as a toner image.

In this exemplary embodiment, "reducing a potential" represents varying the potential to the 0 V side to decrease a negative absolute value. In contrast, "increasing a potential" represents varying the potential to the negative side to increase a negative absolute value.

Furthermore, the image forming section 20 includes a transfer device 40 for transferring a toner image formed by the image forming units 30.

The transfer device 40 includes a transfer belt 41, support rollers 42 and 43, first transfer rollers 44, a second transfer roller 46, and a backup roller 45. The transfer belt 41 is an example of a transfer object, and the first transfer rollers 44 are an example of transfer units.

The transfer belt 41 is an endless belt that is rotatable clockwise, with a front view of FIG. 1. The transfer belt 41 is wound around the support rollers 42 and 43 that support the transfer belt 41 and the backup roller 45 that backs up second transfer of a toner image to the recording paper P. The backup roller 45 is arranged on an inner circumferential surface side of the transfer belt 41 to form a counter electrode for the second transfer roller 46 and applies a second transfer bias in a stable manner.

The first transfer rollers 44 each transfer a toner image developed by the developing device 34 to the transfer belt 41. Specifically, when a first transfer bias is applied from the power source (not illustrated) under the control of the controller 50, the first transfer roller 44 transfers a toner image developed on the photoreceptor 31 by the developing device 34 to the transfer belt 41. The first transfer rollers 44 are arranged at positions facing the photoreceptors 31 with the transfer belt 41 interposed therebetween. The first transfer bias mentioned above has a positive polarity, which is opposite the polarity of toner (negative polarity).

When a second transfer bias is applied from the power source (not illustrated) under the control of the controller 50, the second transfer roller 46 transfers a toner image transferred to the transfer belt 41 to the recording paper P. The second transfer roller 46 is arranged at a position facing the backup roller 45 with the transfer belt 41 interposed therebetween. The second transfer bias mentioned above has a positive polarity, which is opposite the polarity of toner (negative polarity).

Furthermore, the image forming section 20 includes an optical sensor 60 that detects strip developer, which is a strip-shaped developer image formed on the transfer belt 41. The optical sensor 60 is an example of a detector. Strip developer is not formed intentionally when an image is formed but is formed unintentionally as a result of image formation. Strip developer may be a case where only toner is transferred to the transfer belt 41 or a case where toner and carrier are transferred to the transfer belt 41. The optical sensor 60 is arranged between the image forming unit 30K and the support roller 43 and detects strip developer before second transfer to the recording paper P is performed.

The optical sensor 60 irradiates the transfer belt 41 with light emitted from a light emitting part (not illustrated) and receives reflected light at a light receiving part (not illustrated). The optical sensor 60 detects the amount of reflected light to detect strip developer. While receiving reflected light at the light receiving part (not illustrated), the optical sensor 60 transmits a detection signal regarding the amount of received reflected light to the controller 50.

The image forming apparatus 10 in the first exemplary embodiment does not include an electricity eliminator for eliminating (reducing) a photoreceptor potential before the photoreceptors 31 are charged by the charging members 32. In the image forming apparatus 10 according to the first exemplary embodiment, instead of the electricity eliminator mentioned above, the exposure devices 33 and the first transfer rollers 44 reduce the photoreceptor potential. In contrast, a member for increasing the photoreceptor potential in the image forming apparatus 10 is the charging member 32 described above. That is, variations in the photoreceptor potential (increase and decrease in the potential) in the image forming apparatus 10 are performed by the charging members 32, the exposure devices 33, and the first transfer rollers 44.

Next, the controller 50 and a configuration connected to the controller 50 will be described with reference to FIG. 2.

Figure 2:
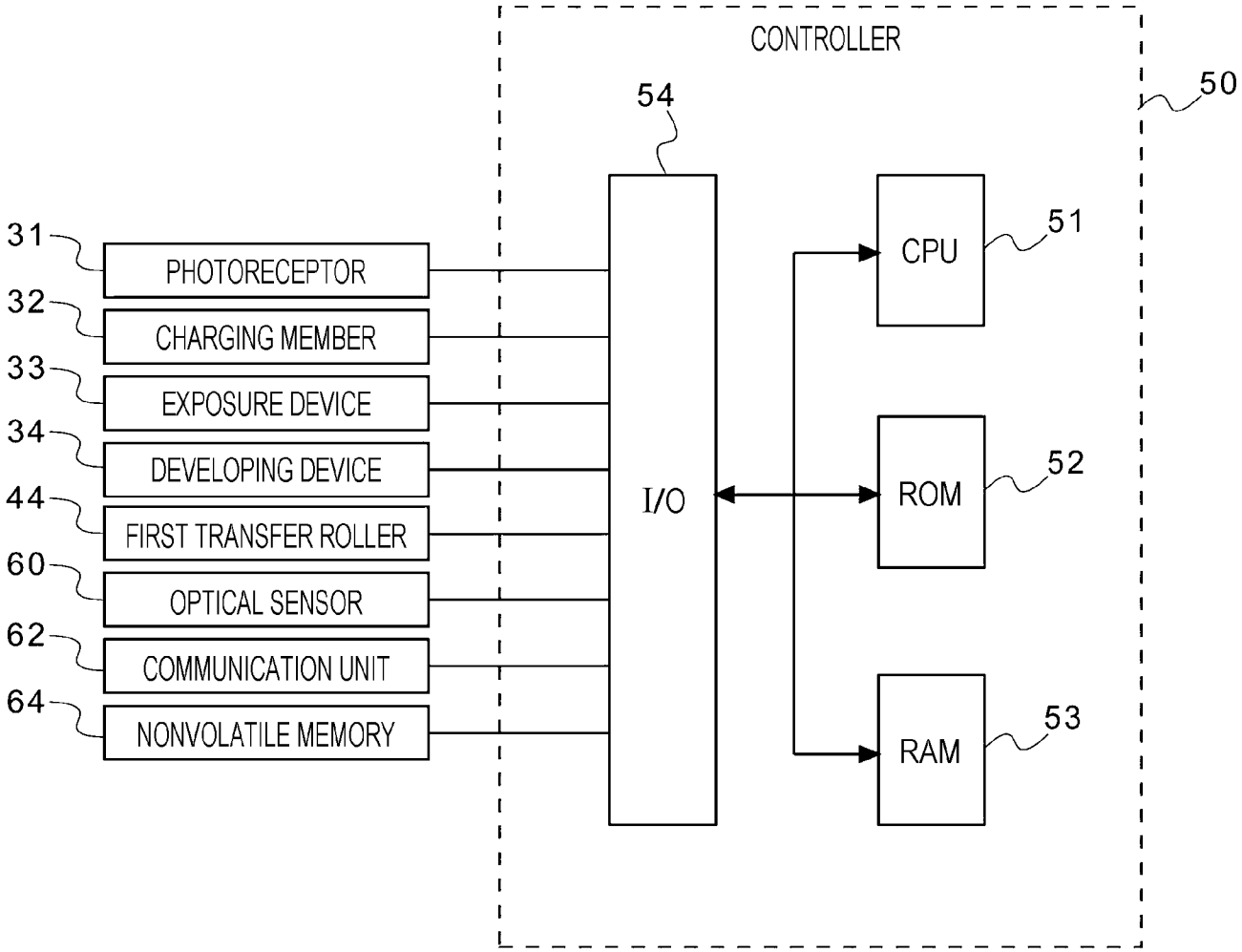
FIG. 2 is a block diagram illustrating a configuration of a controller and other units in an exemplary embodiment.

As illustrated in FIG. 2, the controller 50 includes a central processing unit (CPU) 51, a read only memory (ROM) 52, a random access memory (RAM) 53, and an input/output interface (I/O) 54 that are connected with one another by a bus.

In the ROM 52, an image forming program, which is not illustrated, to be executed by the CPU 51 is stored. The CPU 51 reads the image forming program from the ROM 52 and loads the read image forming program to the RAM 53 to execute an image forming process based on the image forming program.

Furthermore, at least the photoreceptors 31, the charging members 32, the exposure devices 33, the developing devices 34, the first transfer rollers 44, the optical sensor 60, a communication unit 62, and a nonvolatile memory 64 are connected to the I/O 54.

The communication unit 62 is an interface that allows data communication between a terminal apparatus such as a personal computer, which is not illustrated, and the image forming apparatus 10.

Information necessary for the image forming apparatus 10 to perform the image forming process is stored in the nonvolatile memory 64.

Next, a flow from the beginning to ending of a job, which is a predetermined processing unit of the image forming process, will be explained.

For example, when a job is started by transmission of image data from a terminal apparatus such as a personal computer, which is not illustrated, the controller 50 performs cycle-up as a preparation operation for image formation, such as increasing the photoreceptor potential or the potential of the developing roller 35 (hereinafter, referred to as a "developing potential"). A period during which the cycle-up is performed (hereinafter, referred to as a "cycle-up period") is a predetermined period before the image forming section 20 starts image formation. The cycle-up period is an example of a preparation period.

As cycle-up, the controller 50 causes the power source (not illustrated) to apply voltage to the charging members 32 so that the charging members 32 to which the voltage is applied negatively charge the surface of the photoreceptors 31 in a uniform manner at a predetermined potential, and causes the power source to apply a developing bias to the developing rollers 35. The developing bias has a negative polarity, which is the same as the polarity of toner (negative polarity). Therefore, the developing rollers 35 are charged negatively, as with the photoreceptors 31.

After the processing described above, the cycle-up ends.

After the cycle-up ends, the controller 50 causes the exposure devices 33 to irradiate the surface of the photoreceptors 31 charged by the charging member 32 with exposure light, based on image data acquired from the terminal apparatus mentioned above (not illustrated), to form an electrostatic latent image. Accordingly, the electrostatic latent image corresponding to the image data is formed on the surface of the photoreceptors 31.

Next, the controller 50 causes the developing devices 34 to develop the electrostatic latent image formed by the exposure devices 33 to visualize the developed image as a toner image. Furthermore, the controller 50 causes the first transfer rollers 44 to transfer the toner image formed on the surface of the photoreceptors 31 of individual colors to the transfer belt 41.

Furthermore, at a timing when the toner image transferred to the transfer belt 41 reaches a nip part N (see FIG. 1) that is sandwiched between the backup roller 45 and the second transfer roller 46, the controller 50 causes the accommodation unit 12 to send out the recording paper P to be conveyed to the nip part N. The recording paper P that has been conveyed to the nip part N is sandwiched between the backup roller 45 and the second transfer roller 46, so that the toner image that has been first-transferred to the transfer belt 41 is second-transferred to the recording paper P.

Then, the recording paper P to which the toner image has been second-transferred is fixed by the fixation roller 15 and then discharged outside the image forming apparatus body 10A by the discharge roller 16.

When the job is completed, the controller 50 performs cycle-down as a termination operation after image formation, such as reducing the photoreceptor potential and the developing potential. A period during which the cycle-down is performed (hereinafter, referred to as a "cycle-down period") is a predetermined period after image formation by the image forming section 20 is finished. The cycle-down period is an example of a termination period.

As cycle-down, the controller 50 stops application of a developing bias and thus reduces the developing potential. As cycle-down, the controller 50 stops application of voltage to the charging members 32, that is, turns off the power source (not illustrated) for supplying power to the charging members 32.

As cycle-down, the controller 50 reduces the photoreceptor potential by causing the exposure devices 33 to irradiate the entire surface of the photoreceptors 31 with exposure light and causing the first transfer rollers 44 to apply a first transfer bias. Then, by eliminating electricity of a predetermined amount from the photoreceptors 31, the controller 50 causes the exposure devices 33 to stop applying exposure light, and causes the first transfer rollers 44 to stop applying the first transfer bias. That is, by eliminating electricity of the predetermined amount from the photoreceptors 31, the controller 50 turns off the power source (not illustrated) for supplying power to the exposure devices 33 and the first transfer rollers 44.

After the processing described above, the cycle-down ends.

Next, a characteristic control flow in the first exemplary embodiment will be described.

It is known that in the image forming apparatus 10, when a potential difference between the photoreceptor potential and the developing potential falls outside a certain range (for example, −100 V), developer is transitioned from the developing devices 34 to the photoreceptors 31. Therefore, in the image forming apparatus 10, during a period that is not the period during which image formation by the image forming section 20 is performed, for example, during the cycle-down period, when the potential difference between the photoreceptor potential and the developing potential falls outside the certain range, transition of developer from the developing devices 34 to the photoreceptors 31 occurs unintentionally.

Hereinafter, transition of only toner of developer from the developing devices 34 to the photoreceptors 31 will be referred to as "toner transition", and transition of toner and carrier of developer from the developing devices 34 to the photoreceptors 31 will be referred to as "developer transition."

Toner transition occurs in the case where the potential difference between the photoreceptor potential and the developing potential falls outside the certain range and the negative absolute value of the developing potential is greater than the negative absolute value of the photoreceptor potential. In contrast, developer transition occurs in the case where the potential difference between the photoreceptor potential and the developing potential falls outside the certain range and the negative absolute value of the photoreceptor potential is greater than the negative absolute value of the developing potential.

In the image forming apparatus 10, in the case where unintentional toner transition or developer transition occurs during the cycle-down period, transferred developer is deposited on the transfer belt 41, and the recording paper P gets dirty, which may cause an image defect. Furthermore, in the image forming apparatus 10, in the case where unintentional developer transition occurs during the cycle-down period, the surface of the photoreceptors 31 is damaged by carrier transferred to the transfer belt 41, which may shorten the lifetime of the photoreceptors 31.

Thus, in order to suppress occurrence of unintentional toner transition or developer transition during the cycle-down period, a technique for reducing potential step by step while maintaining the potential difference between the photoreceptor potential and the developing potential within the certain range is available.

However, as described above, the image forming apparatus 10 according to the first exemplary embodiment is configured not to include an electricity eliminator for eliminating (reducing) the photoreceptor potential before the photoreceptors 31 are charged by the charging members 32.

Figure 3:
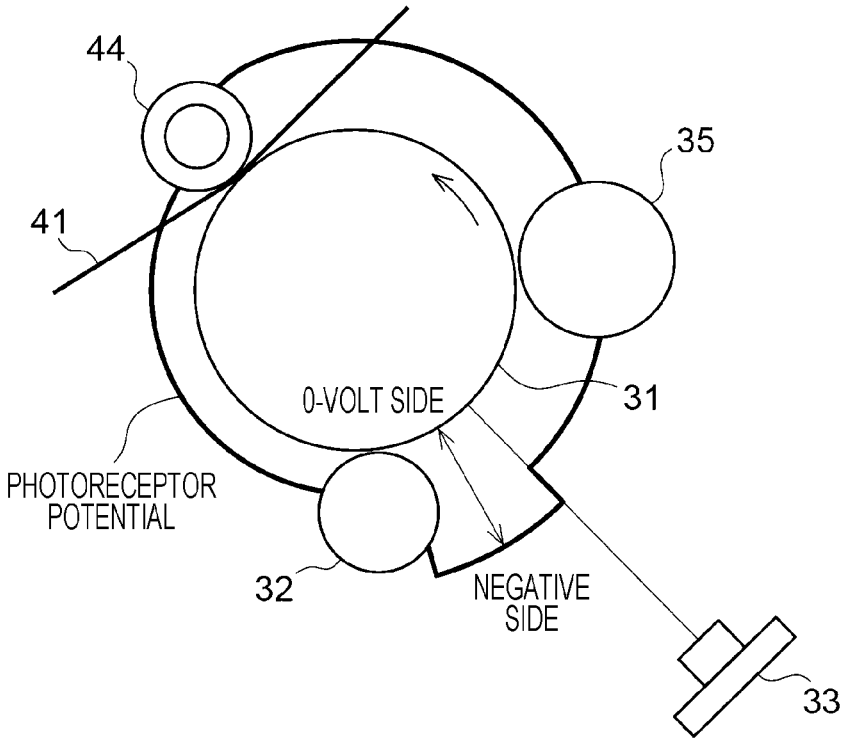
FIG. 3 is an explanatory diagram illustrating variations in a photoreceptor potential (increase and decrease in potential)

In FIG. 3, solid lines surrounding the photoreceptor 31 schematically represent a photoreceptor potential. For the photoreceptor potential, a side receding from the center in the radial direction of the photoreceptor 31 represents a "negative side", and a side approaching the center in the radial direction of the photoreceptor 31 represents a "0 V side".

In the first exemplary embodiment, an electricity eliminator is not provided. Therefore, as illustrated in FIG. 3, the photoreceptor potential when passing through a position at which the photoreceptor 31 faces the charging member 32 is the same as that after passing through the first transfer roller 44. Thus, in the first exemplary embodiment, it is difficult to maintain the same photoreceptor potential in the circumferential direction, and the photoreceptor 31 having non-uniform potential passes through the position facing the developing roller 35. Accordingly, it is difficult to reduce the potential step by step while maintaining the potential difference between the photoreceptor potential and the developing potential within the certain range. Thus, in the cycle-down in the first exemplary embodiment, the photoreceptor potential and the developing potential are reduced to a predetermined potential by a single step.

However, in the image forming apparatus 10, even if the photoreceptor potential and the developing potential are reduced to a predetermined potential by a single step, the potential difference between the photoreceptor potential and the developing potential may fall outside the certain range during the cycle-down period, and toner transition or developer transition may occur unintentionally.

Thus, in the first exemplary embodiment, the optical sensor 60 detects strip developer formed on the transfer belt 41 by occurrence of unintentional toner transition or developer transition during the cycle-down period. Then, in the first exemplary embodiment, the controller 50 adjusts a timing for reducing each of the developing potential and the photoreceptor potential based on the result of detection by the optical sensor 60, and thus suppresses occurrence of image defects in the next image formation. Hereinafter, a timing for reducing the developing potential or the photoreceptor potential will be referred to as a "falling timing".

"Adjustment of a falling timing" represents advancing or delaying the falling timing of one of the developing potential and the photoreceptor potential relative to the falling timing of the other one of the developing potential and the photoreceptor potential.

The adjustment processing for adjusting the falling timing is controlled by the controller 50, and is executed, for example, at the time of manufacturing (shipping) the image forming apparatus 10.

In the adjustment processing, for example, when a predetermined operation is performed for the image forming apparatus 10 and a job starts, the image forming section 20 forms an image of a predetermined pattern (hereinafter, referred to as a "test pattern") on the transfer belt 41. Image data of the test pattern is stored in the ROM 52 of the controller 50.

Next, in the adjustment processing, after the image forming section 20 finishes image formation of the test pattern, the controller 50 performs cycle-down. During the cycle-down period, the optical sensor 60 performs detection of strip developer. After detecting strip developer, the optical sensor 60 transmits a detection signal regarding the amount of the detected reflected light to the controller 50.

Next, in the adjustment processing, based on the detection signal received from the optical sensor 60, the controller 50 calculates the length of the strip developer in the conveying direction being conveyed on the transfer belt 41 (hereinafter, referred to as a "strip developer length"). Furthermore, based on the calculated strip developer length, the controller 50 calculates the time difference between the falling timing of the developing potential and the falling timing of the photoreceptor potential. Then, based on the calculated time difference between the falling timing of the developing potential and the falling timing of the photoreceptor potential, the controller 50 adjusts the falling timing of the developing potential.

The adjustment processing ends when the controller 50 has adjusted the falling timing of the developing potential.

Hereinafter, the adjustment processing mentioned above will be specifically explained with reference to FIGS. 4A and 4B.

Figure 4B:
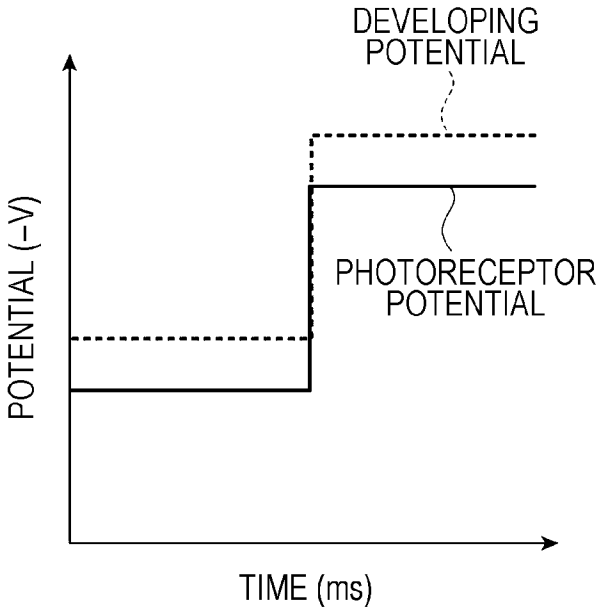
FIGS. 4A and 4B are timing charts each illustrating falling timings of a photoreceptor potential and a developing potential in a first exemplary embodiment.
Figure 4A:
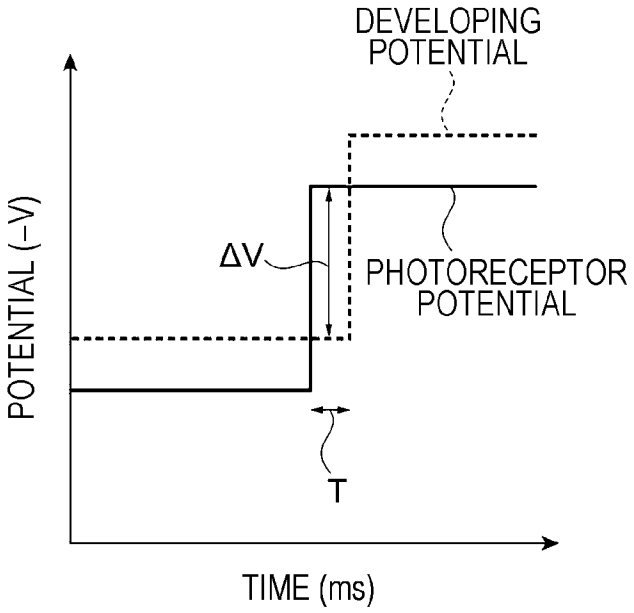

FIGS. 4A and 4B are timing charts each illustrating falling timings of the photoreceptor potential and the developing potential in the first exemplary embodiment. In each of FIGS. 4A and 4B, the horizontal axis represents time (ms), and time passes from left to right in the figure. Furthermore, in each of FIGS. 4A and 4B, the vertical axis represents potential (−V), and the lower side in the figure represents negative, and the upper side in the figure represents 0 V.

FIG. 4A is a timing chart before the controller 50 adjusts the falling timing of the developing potential, and FIG. 4B is a timing chart after the controller 50 adjusts the falling timing of the developing potential.

As illustrated in FIG. 4A, in the cycle-down before the controller 50 adjusts the falling timing of the developing potential, the falling timing of the developing potential, which is indicated by a broken line, is later than the falling timing of the photoreceptor potential, which is indicated by a solid line. During a period T, which is the time difference between the falling timing of the developing potential and the falling timing of the photoreceptor potential, a potential difference $\Delta V$ between the photoreceptor potential and the developing potential falls outside a certain range and the negative absolute value of the developing potential is larger than the negative absolute value of the photoreceptor potential, and therefore, unintentional toner transition occurs. In FIG. 4A, during periods before and after the period T, the potential difference $\Delta V$ between the photoreceptor potential and the developing potential falls within the certain range, and unintentional toner transition does not occur.

During this cycle-down period, detection of strip developer is performed by the optical sensor 60 as described above, and a detection signal regarding the amount of the detected reflected light is transmitted to the controller 50. After that, the controller 50 calculates the length of the strip developer, based on the detection signal received from the optical sensor 60, and calculates the period T, based on the calculated strip developer length. For example, the controller 50 calculates the strip developer length, based on the time of the received detection signal. In the case illustrated in FIG. 4A, the controller 50 calculates a strip developer length of 10 mm. Furthermore, in the case illustrated in FIG. 4A, the controller 50 calculates a period T of 10 ms, based on the strip developer length of 10 mm.

Next, the controller 50 adjusts the falling timing of the developing potential, based on the calculated period T (10 ms). Specifically, the controller 50 advances the falling timing of the developing potential such that the length of the next strip developer to be formed is 5 mm or less while making the falling timing of the developing potential later than the falling timing of the photoreceptor potential. In the example described above, the period T of 1 ms is required to form a strip developer of 1 mm. Therefore, for example, the controller 50 performs adjustment such that the falling timing of the developing potential is advanced by 5 ms.

Furthermore, the adjustment processing is set to be performed repeatedly a plurality of times for individual jobs. In the first exemplary embodiment, the adjustment processing is performed for five jobs. That is, an operation of the adjustment processing is performed for each job, and five adjustment processing operations are performed in total for five jobs.

The adjustment processing is set such that a target value for the length of the next strip developer to be formed decreases as the number of times that adjustment processing has been performed increases. For example, a target value for the first adjustment processing operation is set to "5 mm or less", a target value for the second adjustment processing operation is set to "4 mm or less", a target value for the third adjustment processing operation is set to "3 mm or less", a target value for the fourth adjustment processing operation is set to "2 mm or less", a target value for the fifth adjustment processing operation is set to "1 mm or less".

As a result, the timing chart after the fifth adjustment processing operation is performed is as illustrated in FIG. 4B, and the falling timing of the developing potential is equal to the falling timing of the photoreceptor potential. Therefore, in this case, during the cycle-down period, the potential difference ΔV between the photoreceptor potential and the developing potential does not fall outside the certain range, and unintentional toner transition thus does not occur.

(Operational Effects)

In the adjustment processing, the controller 50 controls at least one of the charging members 32, the exposure devices 33, the developing devices 34, and the first transfer rollers 44, based on the strip developer length detected by the optical sensor 60, such that the falling timing of the photoreceptor potential and the falling timing of the developing potential are equal to each other. Specifically, for the control of the charging members 32, the exposure devices 33, and the first transfer rollers 44, the controller 50 adjusts the timing for turning off the power source (not illustrated) for supplying power to these members (hereinafter, referred to as a "power off timing"), and for the control of the developing devices 34, the controller 50 adjusts the timing for turning off application of a developing bias (hereinafter, referred to as a "developing bias off timing").

In the first exemplary embodiment, in the adjustment processing, the controller 50 adjusts the falling timing of the developing potential relative to the falling timing of the photoreceptor potential. For example, in the case where the falling timing of the developing potential is later than the falling timing of the photoreceptor potential, as illustrated in FIG. 4A, the controller 50 performs adjustment in the adjustment processing such that the falling timing is advanced.

In a comparative configuration, every time that strip developer is formed on the transfer belt 41 and an image defect based on the strip developer occurs, an operator needs to perform adjustment such that the falling timing of the photoreceptor potential is equal to the falling timing of the developing potential.

In contrast, in the first exemplary embodiment, for example, the adjustment processing is performed at the time of manufacturing (shipping) the image forming apparatus 10, and therefore, an operator does not need to perform adjustment every time that an image defect based on strip developer occurs. Accordingly, in the first exemplary embodiment, image defects caused by strip developer may be suppressed easily compared to the comparative configuration described above.

Furthermore, in the first exemplary embodiment, variations in the photoreceptor potential (increase and decrease in potential) is performed by three configurations: the charging members 32; the exposure devices 33; and the first transfer rollers 44, as described above. Therefore, for example, in the adjustment processing, for adjustment of the falling timing of the photoreceptor potential, power off timings of the charging members 32, the exposure devices 33, and the first transfer rollers 44 need to be advanced or delayed so that there is no difference in the power off timing among the charging members 32, the exposure devices 33, and the first transfer rollers 44.

Thus, in the first exemplary embodiment, in the adjustment processing, the falling timing of the developing potential, for which only the developing bias off timing needs to be advanced or delayed, is adjusted. Therefore, in the first exemplary embodiment, in the adjustment processing, image defects caused by strip developer may be suppressed easily compared to the case where the falling timing of the photoreceptor potential, for which power off timings of the charging members 32, the exposure devices 33, and first transfer rollers 44 need to be advanced or delayed, is adjusted.

In the adjustment processing, the optical sensor 60 performs detection of strip developer during the cycle-down period. In the adjustment processing, the controller 50 adjusts, based on the strip developer length detected by the optical sensor 60, the falling timing of the developing potential relative to the falling timing of the photoreceptor potential such that the length of the next strip developer to be formed is less than or equal to a predetermined value, for example, 5 mm. Therefore, in the first exemplary embodiment, image defects caused by strip developer occurring during the cycle-down period may be suppressed.

Furthermore, the controller 50 performs the adjustment processing repeatedly a plurality of times for individual jobs such that the length of the next strip developer to be formed is less than or equal to a predetermined value, for example, a target value for the strip developer length decreases, such as 5 mm or less, 4 mm or less, 3 mm or less, 2 mm or less, and 1 mm or less, as the number of times that the adjustment processing has been performed increases. Therefore, in the first exemplary embodiment, image defects caused by strip developer may be suppressed accurately compared to a configuration in which the adjustment processing is performed in a single job.

Furthermore, in the adjustment processing, for adjustment of the falling timing of the developing potential relative to the falling timing of the photoreceptor potential, the controller 50 performs adjustment such that the falling timing of the developing potential is later than the falling timing of the photoreceptor potential.

For example, in the adjustment processing, for adjustment of the falling timing of the developing potential relative to the falling timing of the photoreceptor potential such that the length of the next strip developer to be formed is less than or equal to 5 mm as in the example illustrated in FIG. 4A, two methods described below are considered.

The first method is to perform adjustment such that the falling timing of the developing potential is advanced by 5 ms, as described above.

The second method is to perform adjustment such that the falling timing of the developing potential is advanced by 15 ms.

However, if the falling timing of the developing potential is earlier than the falling timing of the photoreceptor potential, the potential difference ΔV between the photoreceptor potential and the developing potential falls outside the certain range and the negative absolute value of the photoreceptor potential is larger than the negative absolute value of the developing potential, which causes developer transition. Then, as described above, in the image forming apparatus 10, when developer transition occurs, the surface of the photoreceptors 31 may be damaged by carrier, and the lifetime of the photoreceptors 31 may be shortened.

Thus, in the first exemplary embodiment, in order to avoid occurrence of developer transition, the falling timing of the developing potential is adjusted relative to the falling timing of the photoreceptor potential. Accordingly, in the first exemplary embodiment, failure caused by strip developer may be suppressed compared to a configuration for performing adjustment such that the falling timing of the developing potential is made earlier than the falling timing of the photoreceptor potential.

Second Exemplary Embodiment

Next, a second exemplary embodiment of the present disclosure will be explained while parts explained in the first exemplary embodiment being omitted or simplified.

In the adjustment processing, in order to shorten the strip developer length, the controller 50 in the second exemplary embodiment adjusts the power off timing of at least one of the charging members 32, the exposure devices 33, and the first transfer rollers 44. Specifically, in the adjustment processing, the controller 50 advances or delays the power off timings of the exposure devices 33 and the first transfer rollers 44, based on an ideal timing (control target) based on the power off timing of the charging members 32.

The adjustment processing in the second exemplary embodiment will be explained below with reference to FIGS. 5A and 58. The adjustment processing in the second exemplary embodiment is performed after the adjustment processing in the first exemplary embodiment is performed.

Figure 5B:
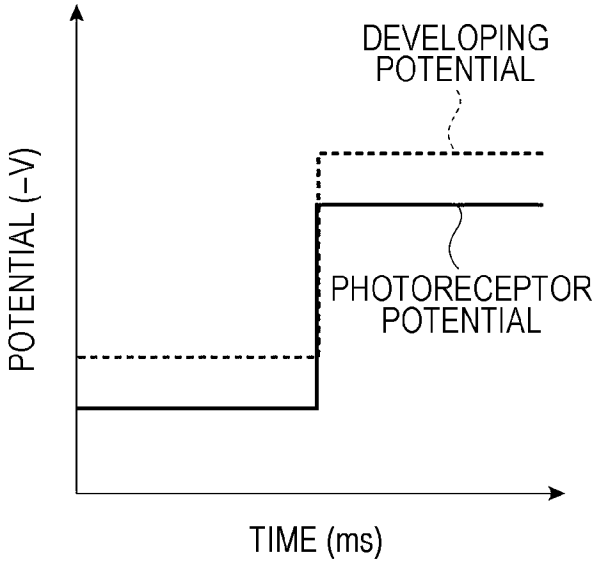
FIGS. 5A and 5B are timing charts each illustrating falling timings of a photoreceptor potential and a developing potential in a second exemplary embodiment.
Figure 5A:
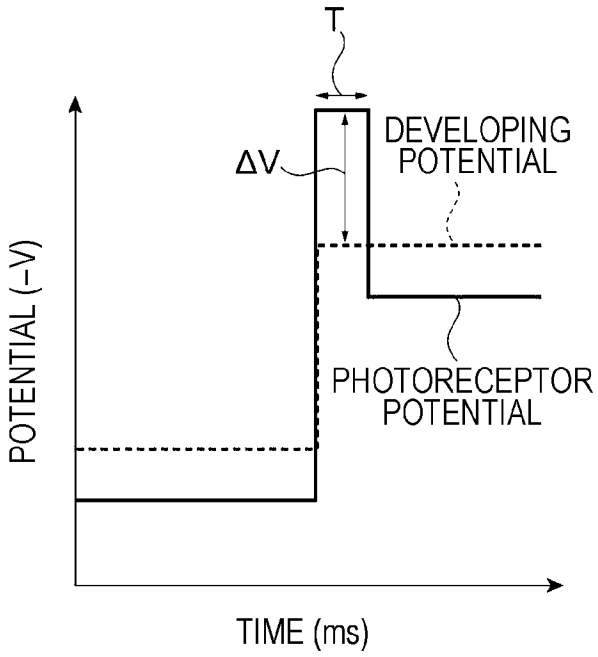

FIGS. 5A and 5B are timing charts each illustrating the falling timings of the photoreceptor potential and the developing potential in the second exemplary embodiment.

FIG. 5A is a timing chart before the controller 50 advances the power off timings of the exposure devices 33 and the first transfer rollers 44. FIG. 5B is a timing chart after the controller 50 advances the power off timings of the exposure devices 33 and the first transfer rollers 44.

As illustrated in FIG. 5A, during the cycle-down before the controller 50 advances the power off timings of the exposure devices 33 and the first transfer rollers 44, the falling timing of the developing potential is equal to the falling timing of the photoreceptor potential. However, in the cycle-down, during the period T, the potential difference ΔV between the photoreceptor potential and the developing potential falls outside the certain range and the negative absolute value of the developing potential is larger than the negative absolute value of the photoreceptor potential. Therefore, unintentional toner transition occurs.

During the cycle-down period, the optical sensor 60 performs detection of strip developer, and a detection signal regarding the amount of the detected reflected light is transmitted to the controller 50. After that, the controller 50 calculates the length of the strip developer, based on the detection signal received from the optical sensor 60, and calculates the period T, based on the calculated strip developer length. For example, in the case illustrated in FIG. 5A, the controller 50 calculates a strip developer length of 10 mm. Furthermore, in the case illustrated in FIG. 5A, the controller 50 calculates a period T of 10 ms, based on the strip developer length of 10 mm.

Next, the controller 50 adjusts the power off timings of the exposure devices 33 and the first transfer rollers 44 while maintaining the power off timing and the developing bias off timing of the charging members 32, based on the calculated period T (10 ms).

In the case illustrated in FIG. 5A, the power off timings of the exposure devices 33 and the first transfer rollers 44 are too late relative to an ideal timing based on the power off timing of the charging members 32, and therefore, unintentional toner transition occurs. In other words, in the case illustrated in FIG. 5A, the photoreceptor potential is reduced too much by the exposure devices 33 and the first transfer rollers 44, and unintentional toner transition thus occurs.

Therefore, in the first adjustment processing operation, the controller 50 advances the power off timings of the exposure devices 33 and the first transfer rollers 44 such that the length of the next strip developer to be formed is 5 mm or less. For example, the controller 50 performs adjustment such that the power off timings of the exposure devices 33 and the first transfer rollers 44 are advanced by 5 ms.

The timing chart after the fifth adjustment processing operation is performed is as illustrated in FIG. 5B, in which the potential difference ΔV between the photoreceptor potential and the developing potential does not fall outside the certain range during the cycle-down period. Therefore, in the state illustrated in FIG. 5B after adjustment processing is performed, unintentional toner transition does not occur.

As described above, in the adjustment processing, the controller 50 in the second exemplary embodiment adjusts not only the falling timing of the developing potential but also the power off timings of the exposure devices 33 and the first transfer rollers 44. Therefore, according to the second exemplary embodiment, in the adjustment processing, image defects caused by strip developer may be suppressed accurately compared to a configuration in which only the falling timing of the developing potential is adjusted.

(Others)

Figure 6B:
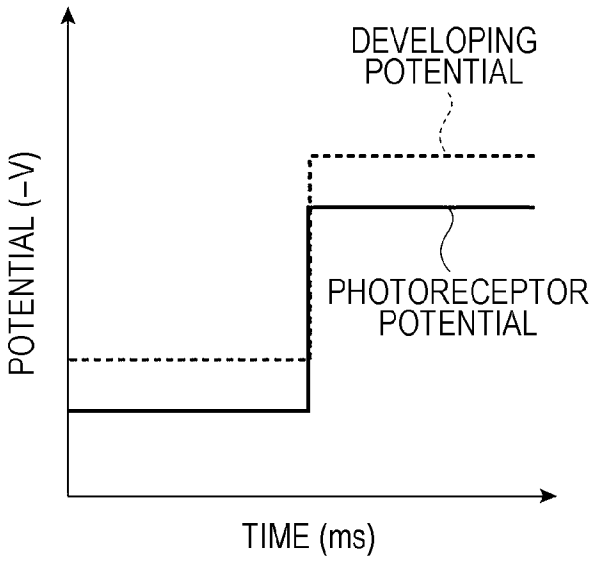
FIGS. 6A and 6B are another example of timing charts each illustrating falling timings of a photoreceptor potential and a developing potential.
Figure 6A:
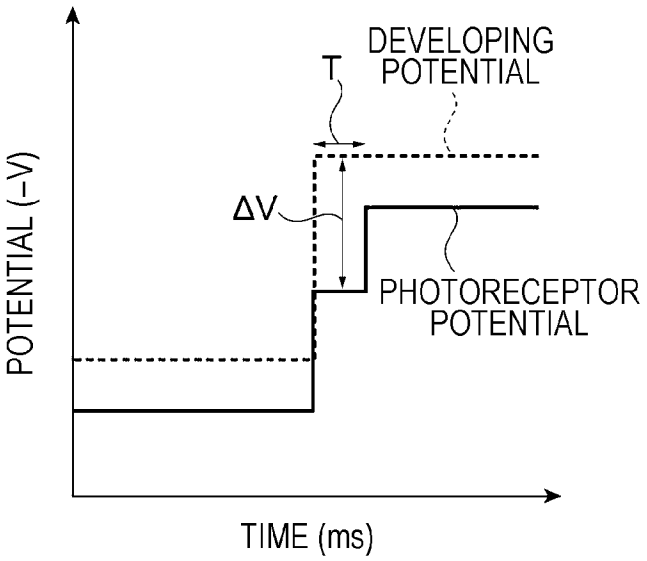

In the foregoing exemplary embodiments, the optical sensor 60 detects strip developer based on unintentional toner transition, and the controller 50 performs control based on the length of the strip developer detected by the optical sensor 60. However, the present disclosure is not limited to this. As illustrated in FIGS. 6A and 6B, the optical sensor 60 may detect strip developer based on unintentional developer transition occurring in the cycle-down period, and the controller 50 may perform the control, described above, based on the length of the strip developer detected by the optical sensor 60.

For example, in the case illustrated in FIG. 6A, the power off timings of the exposure devices 33 and the first transfer rollers 44 are too early relative to an identical timing based on the power off timing of the charging members 32, and therefore, unintentional developer transition occurs. In other words, in the case illustrated in FIG. 6A, surfaces of the photoreceptors 31 have a part where electricity elimination by the exposure devices 33 and the first transfer rollers 44 is not performed adequately, and unintentional developer transition thus occurs.

Therefore, in the first adjustment processing operation, the controller 50 delays the power off timings of the exposure devices 33 and the first transfer rollers 44 such that the length of the next strip developer to be formed is 5 mm or less. For example, the controller 50 performs adjustment such that the power off timings of the exposure devices 33 and the first transfer rollers 44 are delayed by 5 ms.

The timing chart after the fifth adjustment processing operation is performed is as illustrated in FIG. 6B, and the potential difference ΔV between the photoreceptor potential and the developing potential does not fall outside the certain range during the cycle-down period. Therefore, in the state illustrated in FIG. 6B after the adjustment processing is performed, unintentional developer transition does not occur.

In the foregoing exemplary embodiments, in the adjustment processing, the controller 50 adjusts the falling timing of the developing potential relative to the falling timing of the photoreceptor potential. That is, in the adjustment processing in the foregoing exemplary embodiments, the falling timing of the developing potential is advanced or delayed. However, the present disclosure is not limited to this. The adjustment processing may be adjusting the falling timing of the photoreceptor potential relative to the falling timing of the developing potential to advance or delay the falling timing of the photoreceptor potential.

In the foregoing exemplary embodiments, in the adjustment processing, the controller 50 advances or delays the power off timings of the exposure devices 33 and the first transfer rollers 44, based on an ideal timing based on the power off timing of the charging member 32. However, the present disclosure is not limited to this. In the adjustment processing, the controller 50 may advance or delay the power off timing of the charging members 32, based on ideal timings based on the power off timings of the exposure devices 33 and the first transfer rollers 44.

In the foregoing exemplary embodiments, in the adjustment processing, the controller 50 controls at least one of the charging members 32, the exposure devices 33, the developing devices 34, and the first transfer rollers 44, based on the length of strip developer detected by the optical sensor 60, such that the falling timings of the photoreceptor potential and the developing potential are equal to each other. However, the present disclosure is not limited to this. In the adjustment processing, the controller 50 may perform control similar to that in the foregoing exemplary embodiments such that the rising timings as timings for rising the photoreceptor potential and the developing potential are equal to each other. Furthermore, in the adjustment processing, the controller 50 may perform control similar to that in the foregoing exemplary embodiments such that the rising timings and falling timings of the photoreceptor potential and the developing potential are equal to each other.

In the adjustment processing in this case, it is desirable that the optical sensor 60 is configured to detect strip developer during at least one of the cycle-up period and the cycle-down period. With this configuration, image defects caused by strip developer occurring during at least one of the cycle-up period and the cycle-down period may be suppressed.

In the foregoing exemplary embodiments, the adjustment processing is performed at the time of manufacturing (shipping) the image forming apparatus 10. However, the adjustment processing may be performed at the time of replacing a member regarding variations in the photoreceptor potential and the developing potential, in addition to the time of manufacturing (shipping) the image forming apparatus 10. Specifically, the adjustment processing may be performed at the time of replacing the photoreceptors 31, the charging members 32, the exposure devices 33, the developing devices 34, or the first transfer rollers 44.

In the adjustment processing in the foregoing exemplary embodiments, an image of a test pattern is formed on the transfer belt 41. However, the present disclosure is not limited to this. In the adjustment processing, an image of image data transmitted from a terminal apparatus such as a personal computer, which is not illustrated, may be formed on the transfer belt 41, and strip developer generated from the image may be detected by the optical sensor 60.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a photoreceptor;

a charging unit that charges the photoreceptor;

an exposure unit that exposes the photoreceptor charged by the charging unit to light and forms an electrostatic latent image on the photoreceptor;

a developing unit that develops the electrostatic latent image that has been formed on the photoreceptor by exposing the photoreceptor by the exposing unit;

a transfer unit that transfers an image obtained by development by the developing unit to a transfer object;

a detector that detects strip developer, which is a strip-shaped developer image formed on the transfer object; and a controller that controls at least one of the charging unit, the exposure unit, the developing unit, and the transfer unit, based on a length of the strip developer in a conveying direction detected by the detector, such that timings for varying potentials of the photoreceptor and the developing unit in a same direction are equal to each other.

2. The image forming apparatus according to claim 1, wherein the controller adjusts the timing for varying the potential of the developing unit relative to the timing for varying the potential of the photoreceptor.

3. The image forming apparatus according to claim 2, wherein the controller adjusts the timing for varying the potential of the photoreceptor by one of the charging unit and a pair of the exposure unit and the transfer unit, relative to the timing for varying the potential of the photoreceptor by an other one of the charging unit and the pair of the exposure unit and the transfer unit.

4. The image forming apparatus according to claim 3, wherein the detector performs detection of the strip developer during at least one of a preparation period during which a preparation operation for image formation is performed and a termination period during which a termination operation after image formation is performed, and wherein the controller controls at least one of the charging unit, the exposure unit, the developing unit, and the transfer unit, based on the length of the strip developer in the conveying direction detected by the detector, such that the length of a next strip developer to be formed in the conveying direction is less than or equal to a predetermined value.

5. The image forming apparatus according to claim 4, wherein the controller performs control of at least one of the charging unit, the exposure unit, the developing unit, and the transfer unit repeatedly a plurality of times for individual jobs, a job being a predetermined processing unit of an image forming process.

6. The image forming apparatus according to claim 5, wherein an electricity eliminator that eliminates the potential of the photoreceptor before the photoreceptor is charged by the charging unit is not provided, and wherein the controller performs adjustment such that the timing for varying the potential of the developing unit is later than the timing for varying the potential of the photoreceptor.

7. The image forming apparatus according to claim 4, wherein an electricity eliminator that eliminates the potential of the photoreceptor before the photoreceptor is charged by the charging unit is not provided, and wherein the controller performs adjustment such that the timing for varying the potential of the developing unit is later than the timing for varying the potential of the photoreceptor.

8. The image forming apparatus according to claim 3, wherein an electricity eliminator that eliminates the potential of the photoreceptor before the photoreceptor is charged by the charging unit is not provided, and wherein the controller performs adjustment such that the timing for varying the potential of the developing unit is later than the timing for varying the potential of the photoreceptor.

9. The image forming apparatus according to claim 2, wherein the detector performs detection of the strip developer during at least one of a preparation period during which a preparation operation for image formation is performed and a termination period during which a termination operation after image formation is performed, and wherein the controller controls at least one of the charging unit, the exposure unit, the developing unit, and the transfer unit, based on the length of the strip developer in the conveying direction detected by the detector, such that the length of a next strip developer to be formed in the conveying direction is less than or equal to a predetermined value.

10. The image forming apparatus according to claim 9, wherein the controller performs control of at least one of the charging unit, the exposure unit, the developing unit, and the transfer unit repeatedly a plurality of times for individual jobs, a job being a predetermined processing unit of an image forming process.

11. The image forming apparatus according to claim 10, wherein an electricity eliminator that eliminates the potential of the photoreceptor before the photoreceptor is charged by the charging unit is not provided, and wherein the controller performs adjustment such that the timing for varying the potential of the developing unit is later than the timing for varying the potential of the photoreceptor.

12. The image forming apparatus according to claim 9, wherein an electricity eliminator that eliminates the potential of the photoreceptor before the photoreceptor is charged by the charging unit is not provided, and wherein the controller performs adjustment such that the timing for varying the potential of the developing unit is later than the timing for varying the potential of the photoreceptor.

13. The image forming apparatus according to claim 2, wherein an electricity eliminator that eliminates the potential of the photoreceptor before the photoreceptor is charged by the charging unit is not provided, and wherein the controller performs adjustment such that the timing for varying the potential of the developing unit is later than the timing for varying the potential of the photoreceptor.

14. The image forming apparatus according to claim 1, wherein the detector performs detection of the strip developer during at least one of a preparation period during which a preparation operation for image formation is performed and a termination period during which a termination operation after image formation is performed, and wherein the controller controls at least one of the charging unit, the exposure unit, the developing unit, and the transfer unit, based on the length of the strip developer in the conveying direction detected by the detector, such that the length of a next strip developer to be formed in the conveying direction is less than or equal to a predetermined value.

15. The image forming apparatus according to claim 14, wherein the controller performs control of at least one of the charging unit, the exposure, unit, the developing unit, and the transfer unit repeatedly a plurality of times for individual jobs, a job being a predetermined processing unit of an image forming process.

16. The image forming apparatus according to claim 15, wherein an electricity eliminator that eliminates the potential of the photoreceptor before the photoreceptor is charged by the charging unit is not provided, and wherein the controller performs adjustment such that the timing for varying the potential of the developing unit is later than the timing for varying the potential of the photoreceptor.

17. The image forming apparatus according to claim 14, wherein an electricity eliminator that eliminates the potential of the photoreceptor before the photoreceptor is charged by the charging unit is not provided, and wherein the controller performs adjustment such that the timing for varying the potential of the developing unit is later than the timing for varying the potential of the photoreceptor.

18. The image forming apparatus according to claim 1, wherein an electricity eliminator that eliminates the potential of the photoreceptor before the photoreceptor is charged by the charging unit is not provided, and wherein the controller performs adjustment such that the timing for varying the potential of the developing unit is later than the timing for varying the potential of the photoreceptor.

19. An image forming apparatus comprising:

a photoreceptor;

charging means for charging the photoreceptor;

exposure means for exposing the photoreceptor charged by the charging means to light and forming an electrostatic latent image on the photoreceptor;

developing means for developing the electrostatic latent image that has been exposed by the exposure means and formed on the photoreceptor;

transfer means for transferring an image obtained by development by the developing means to a transfer object;

detecting means for detecting strip developer, which is a strip-shaped developer image formed on the transfer object; and control means for controlling at least one of the charging means, the exposure means, the developing means, and the transfer means, based on a length of the strip developer in a conveying direction detected by the detecting means, such that timings for varying potentials of the photoreceptor and the developing means in a same direction are equal to each other.

* * * * *